US005156582A

United States Patent [19]

Thompson

[11] Patent Number: 5,156,582

[45] Date of Patent: Oct. 20, 1992

[54] BOX ERECTOR

[76] Inventor: Johnnie W. Thompson, 1614 Highway 418, Pelzer, S.C. 29669

[21] Appl. No.: 721,690

[22] Filed: Jun. 26, 1991

[51] Int. Cl.[5] ..... B31B 5/72; B31B 5/80

[52] U.S. Cl. ..... 493/117; 493/123; 493/125; 493/127; 493/316

[58] Field of Search ..... 493/117, 123, 124, 125, 493/126, 127, 316

[56] References Cited

U.S. PATENT DOCUMENTS

| | | | |
|---|---|---|---|
| 2,289,820 | 7/1942 | Ardell | 493/316 |
| 3,451,318 | 6/1969 | Arnaldon et al. | 493/319 |
| 3,691,724 | 9/1972 | Lense et al. | 493/117 |
| 3,739,696 | 6/1973 | Pearson | 493/316 |
| 4,069,093 | 1/1978 | Linner | 493/117 |
| 4,285,679 | 8/1981 | Wahle | 493/317 |
| 4,498,893 | 2/1985 | Odom | 493/316 |
| 5,024,640 | 6/1991 | Saitoh | 493/317 |

*Primary Examiner*—William E. Terrell
*Attorney, Agent, or Firm*—Cort Flint

[57] ABSTRACT

A box erector for erecting a box from a knock-down configuration into an open rectangular box is disclosed which includeds a frame (10) for an inventory section (20), a transfer section (22), a flap closure section (24), a taping section (26), and an exit section (28). A transfer arm (A) pivots to a pick-up position where a vacuum assembly (B) picks up a top box and pivots the top box to a box-opening position at approximately 79° from the pick-up position. At the box-opening position, the box is rotated 45° from its horizontal pick-up position, and first and second arms (78, 80) of vacuum assembly (B) open the box to a rectangular shape. Thereafter, the transfer arm moves the box to closure section (22). A drive belt (88) and drive pulleys (**88*a*, 88*b*) rotate vacuum assembly (B) so that the box is vertically oriented when deposited at flap closure section (24). A pressure foot (92) extends into the box at the closure section and holds the box against the end flaps (29*a*) and side flaps (31*a*) as they are closed. The closed flaps are then moved across taping section (26) by horizontal movement of pressure foot (92). The flaps are taped closed, and the box is moved to exit section (28**) where it is released upon demand from a product feed line.

40 Claims, 8 Drawing Sheets

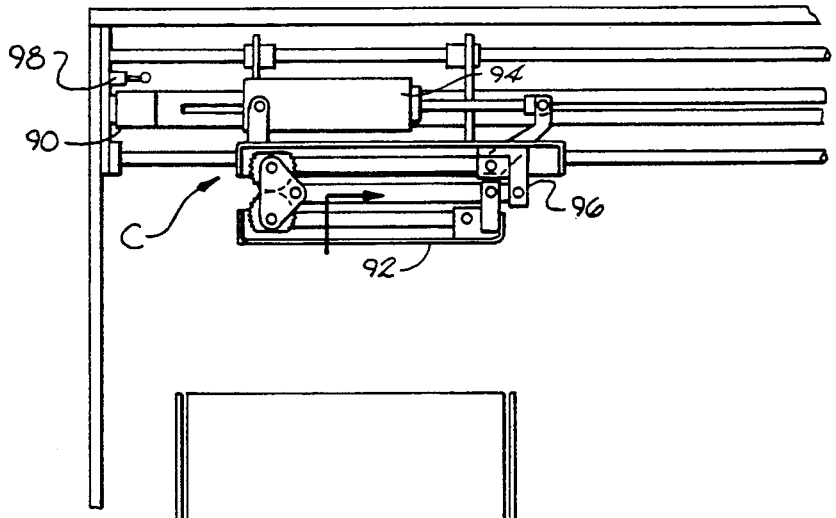
Fig. 6
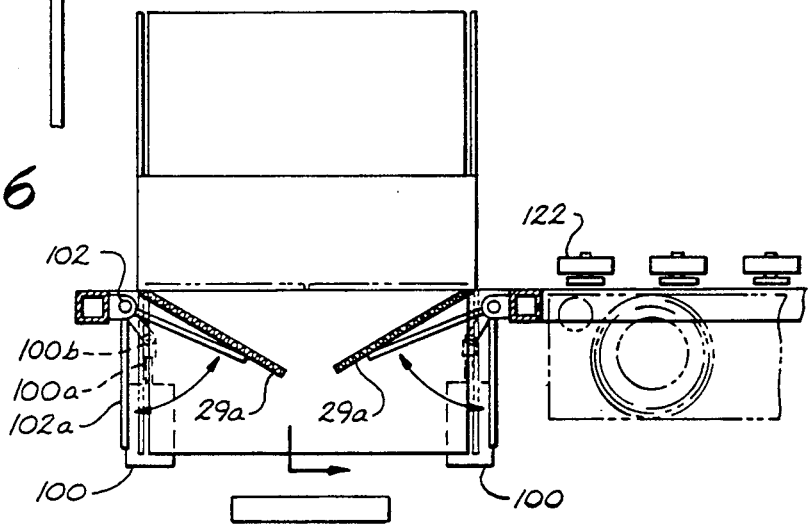
Fig. 7
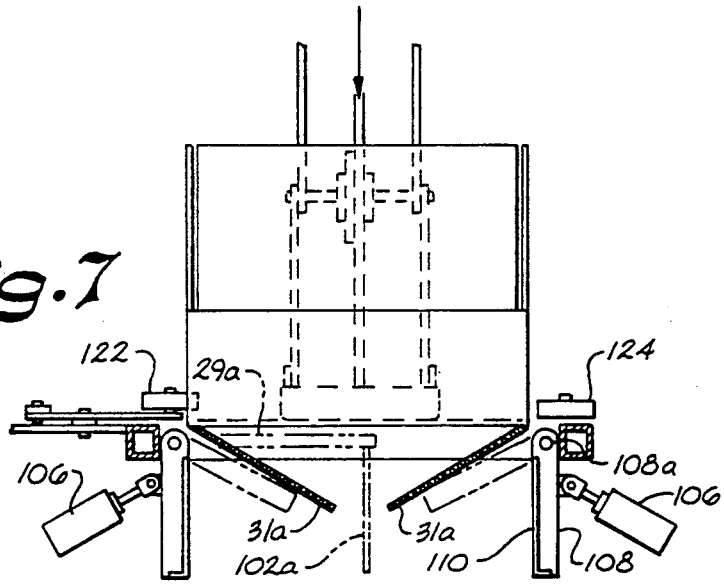

BOX ERECTOR

BACKGROUND OF THE INVENTION

The invention relates to a box erector for erecting boxes from a knock-down condition.

Heretofore, box erector apparatus have been proposed for setting up folded carton or box planks, closing their bottom flaps, and sealing the bottom flaps so that the box may be loaded. For example, see U.S. Pat. Nos. 4,579,551; 4,348,853; and Re27,631. Pat. No. Re27,631 discloses a box erector which utilizes suction for grasping portions of the knock-down carton during erection, and various actuators for closing the end and side flaps. While apparatus have been previously proposed for automatically erecting boxes, they have not been entirely suitable, particularly, as an adjoining operation to an existing product line whereby boxes can be erected and fed to a feeding system for filling of the boxes with packaged products and the like. In addition, the prior box erectors have been relatively complicated in construction, and have required a large amount of floor space. This has made them particularly unsuitable for utilization in existing floor space as an adjunct to an existing product line for erecting the boxes to be filled at the product line in conjunction with the manufacturing of products.

Accordingly, an object of the invention is to provide a box erector having a small footprint which can be utilized without modification with an existing product feeding system.

Another object of the invention is to provide a compact box erector which is simple, yet reliable, and can be utilized as an adjunct to an existing product feeding system for boxing of the product.

Another object of the invention is to provide a box erector which may be utilized to erect different size boxes without complicated alteration of the erector.

Another object of the invention is to provide a box erector which erects boxes taken from an inventory of boxes stacked in a knock-down condition in a simple and reliable manner.

SUMMARY OF THE INVENTION

The above objectives are accomplished according to the invention by providing an apparatus for erecting a rectangular box from a folded knock-down box which requires a small amount of floor space and may be displayed adjacent a product feed line to package product in the erected boxes in a continuous automatic manner.

The apparatus includes an inventory section which includes an inventory of stacked knock-down boxes with a top box in a pick-up position. A transfer section includes transfer means for picking up the top box disposed on top of stacked knock-down boxes and transferring the top box to a box-opening position. The transfer means includes a box opening means for opening the box into an open rectangular box at the box-opening position. A closure section receives the rectangular box at a box closure position, and includes a flap closure assembly for folding a pair of end and side flaps of the box inward for closure. The transfer means transfers the open rectangular box from the box-opening position to closure section only after the box has been opened. A taping section includes a taping unit for securing the end and side flaps in a closed configuration to form a box enclosure. An indexing means raises the stack of knock-down boxes a prescribed distance each time the transfer means picks up one of the top boxes so that a box previously underneath the top box is raised to a predetermined pick-up height and becomes a new top box. A release means is provided for releasing the indexing means so that platform may be returned to a bottom position for reloading of a stack of knock-down boxes. A brake means brakes the descent of the platform when lowered to reload position.

Preferably, the transfer means includes a transfer arm, and a transfer drive for rotating the transfer arm through a prescribed angle between the box pick-up, box opening, and the box closure positions. The transfer drive includes first drive for rotating the transfer arm through a first prescribed angle between the box closure and the pick-up positions, and for rotating the transfer arm through a second prescribed angle less than the first prescribed angle, and in an opposite direction. The transfer drive includes a base pivot having a pinion gear affixed to the transfer arm and carried by the base pivot. The first drive includes a rack gear meshing with the pinion, and a first fluid cylinder having a piston rod affixed to the rack gear, and a second fluid cylinder carried by the frame having a piston rod on which the first fluid cylinder is carried. Both fluid cylinders are actuated to move the transfer arm between the closure and pick-up positions. One of the first and second fluid cylinders rotates the transfer arm from the pick-up position to the box-opening position, and the other of the fluid cylinders rotates the transfer arm from the box-opening position to the closure position. The first prescribed angle is about 158°, and the second prescribed angle is about 45° from the pick-up position. A vacuum assembly is carried by the transfer arm for picking up one side and an end of the top box. The vacuum assembly includes a first arm having suction devices for engaging the side of the knock-down box in the pick-up position, and a second, pivotal arm having suction devices for engaging the end of the knock-down box in the box-opening position. The second pivotal arm includes a pivot having a displaceable pivot rod having a first position in which said pivotal arm engages the end of the knock-down box, and a second, axially displaced position corresponding to engagement with the end when the end is perpendicular to side of open rectangular box. The transfer drive includes a second drive for rotating the vacuum assembly generally 90° to rotate the box horizontally from the pick-up position to an erect vertical orientation at the closure position as the transfer arm rotates between the pick-up and closure positions. The second drive includes a belt drive connected between the base pivot and an end pivot carried near an end of the transfer arm which pivotally carries the vacuum assembly. The belt drive includes drive pulleys carried by the base pivot and the end pivot carry about which an endless belt is carried to provide a desired drive ratio to rotate the vacuum assembly generally 90° as the transfer arm is rotated substantially more than 90° between the box pick-up and closure positions.

The closure section includes a pressure foot assembly which includes a pressure foot and first actuating means for moving the pressure foot vertically between a retracted position and a lowered position wherein the pressure foot engages an inside bottom of the box in the closure section to exert pressure on the box for closure of the end and side flaps. There is a second actuating means for moving the pressure foot horizontally from the closure section, through the taping section, to an exit section. The closure section includes an end flap closure means for closing the end flaps of the box, and a side flap closure means for closing the side flaps of the box. The end flap closure means includes a movable bar which engages the end flaps and fits within a gap defined by adjacent edges of the side flaps for holding the end flaps closed while the side flaps are being closed upon end flaps. There is a first closure actuating means for moving the bar to engage and close end flaps. The side flap closure means includes an elongated closure member engaging the side flaps over a substantial length of the side flaps. There is a second closure actuating means for moving the elongated closure member to engage and close the side flaps upon end flaps. The pressure foot then moves the box with closed flaps over the taping section where the flaps are taped closed. The box is then released from the exit section when the product feed line demands an empty box.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 6 is a side elevation illustrating a flap closure section of a box erector according to the invention;

FIG. 7 is an end view of a flap closure section of a box erector according to the invention;

DESCRIPTION OF A PREFERRED EMBODIMENT

Figure 1:
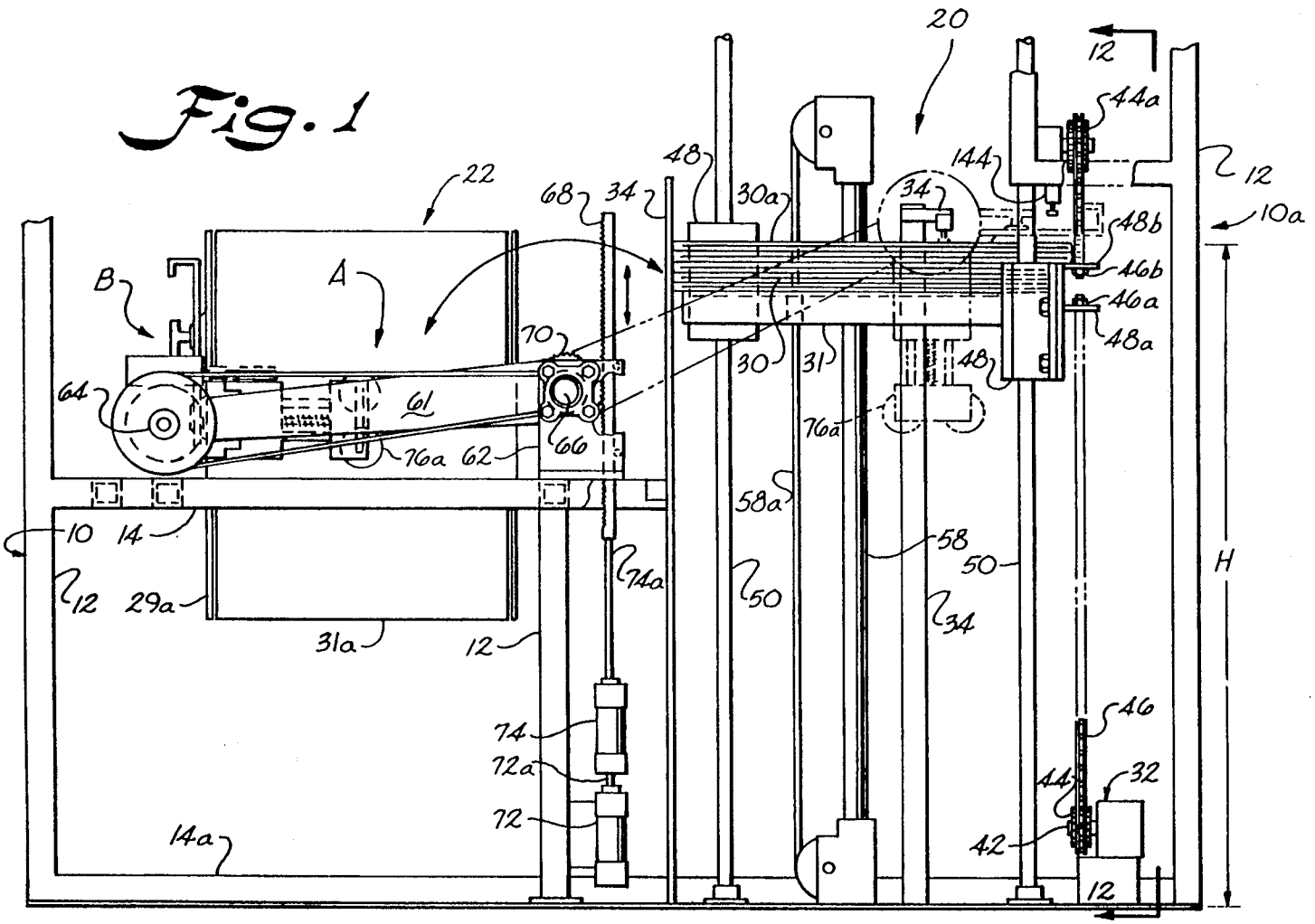
FIG. 1 is a side elevation of a box erector according to the invention illustrating an inventory section and a transfer section of the invention.

Referring now in more detail to the drawings, FIG. 1 is a side view of a box erector according to the invention which includes a frame 10 having vertical frame elements 12 and various horizontal frame elements 14 including base frame elements 14*a*. The box erector has five major sections. There is an inventory section 20, a transfer section 22, a flap closure section 24, a taping section 26, and an exit section 28.

Figure 2:
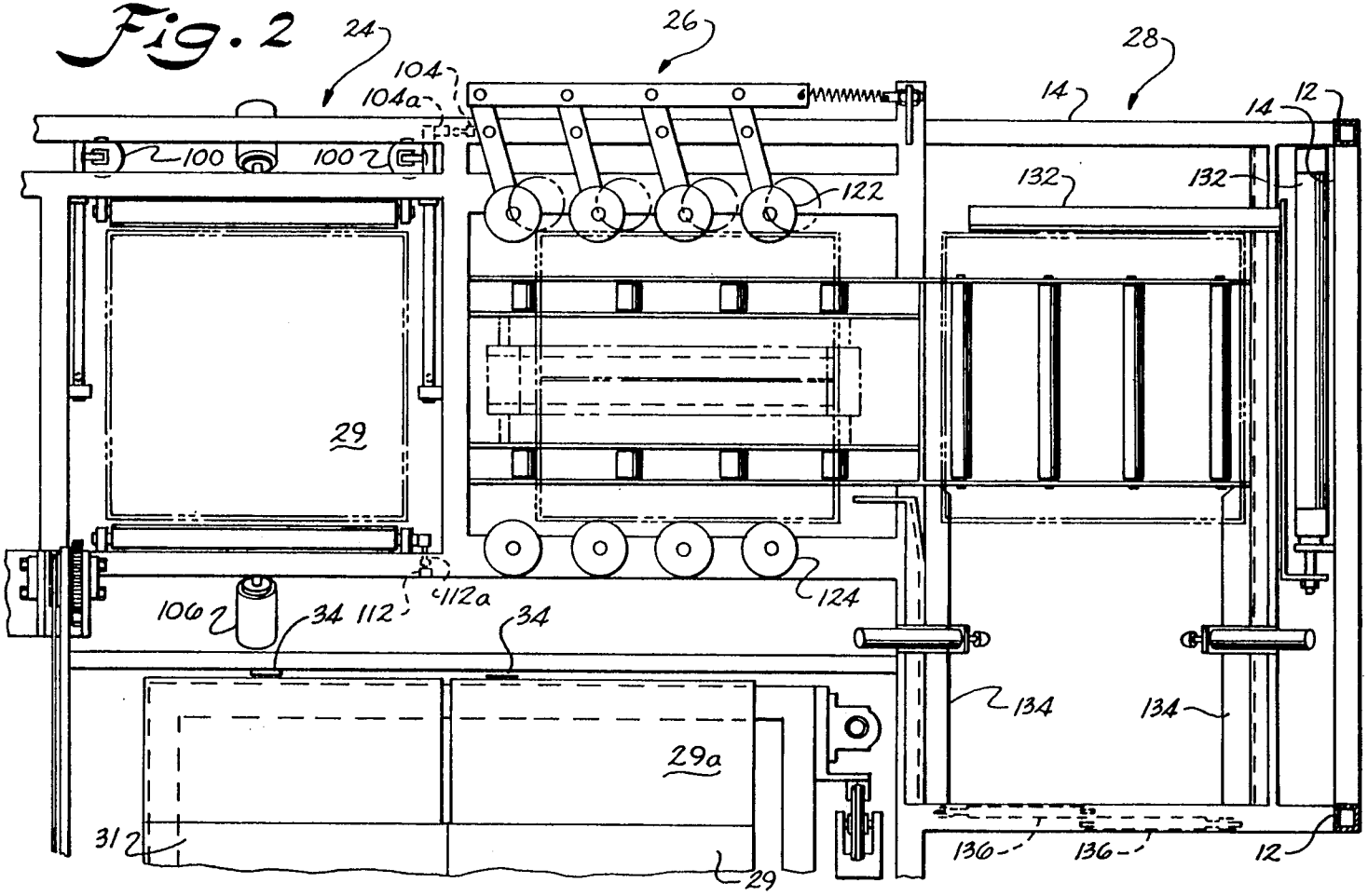
FIG. 2 is a top plan view of a box erector according to the invention illustrating a flap closure section, a taping section, and an exit section thereof.

Inventory section 20 includes a vertical stack of cardboard boxes 30 carried on a platform 31 whereby a top box 30*a* may be picked up from the top of the inventory. A ratchet mechanism 32 indexes the inventory to maintain a constant height H for each box erection cycle. A height sensor valve 34 senses the presence of top box 30*a* when in a proper position for being picked up by a transfer arm assembly, designated generally as A. Boxes 30 are held in alignment by an alignment means provided by a plurality of guide bars 34. Preferably, there are a pair of guide bars 34 spaced along the bottom of the box and a single guide bar along the sides of the box (FIG. 2). There are no guide bars across a side 10*a* of frame 10 since access to the platform needs to be unrestricted for loading of boxes from the side.

Figure 10:
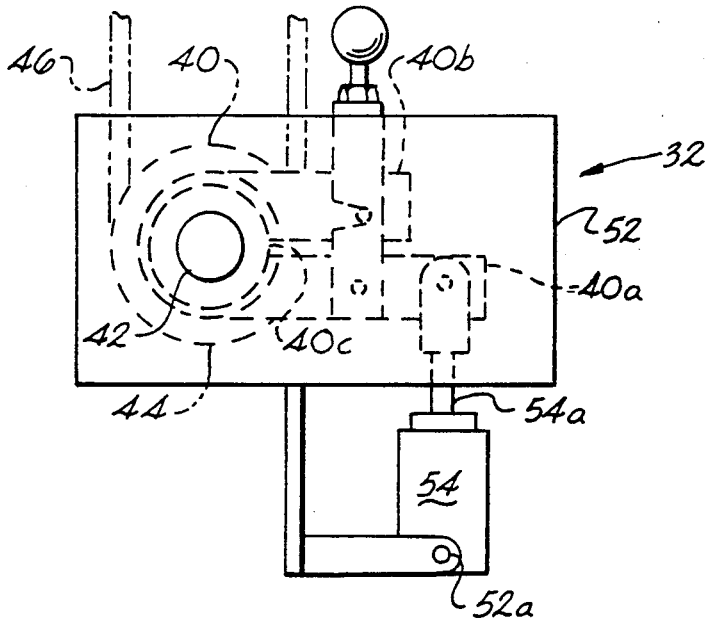
FIG. 10 is a side elevation of a ratchet assembly for indexing an inventory platform which vertically advances an inventory of knock-down boxes for erection according to the invention.
Figure 11:
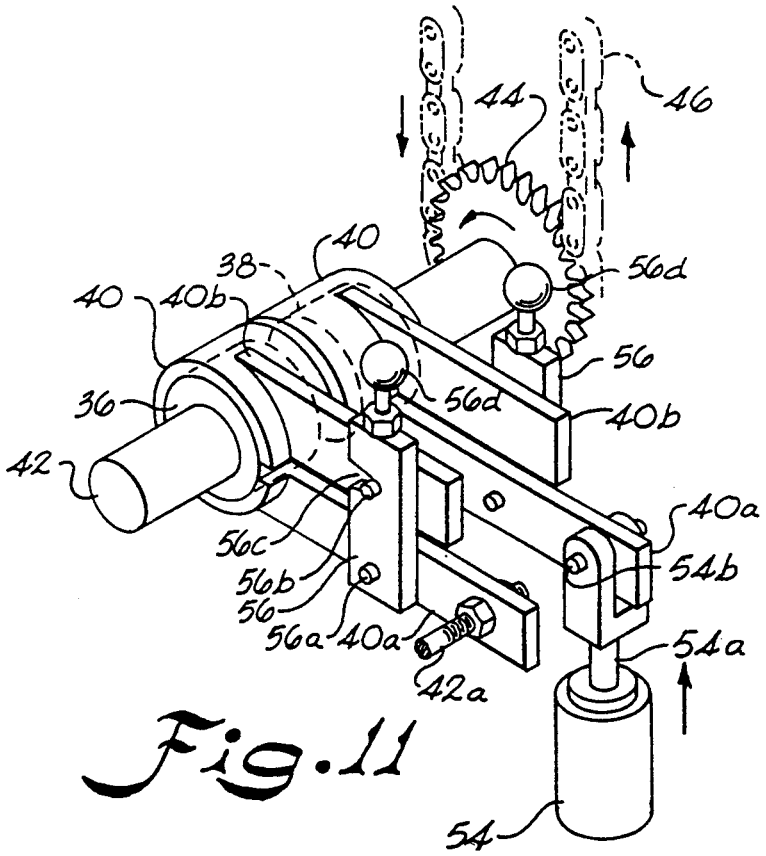
FIG. 11 is a perspective view of a ratchet assembly and drive therefore according to the invention.
Figure 12:
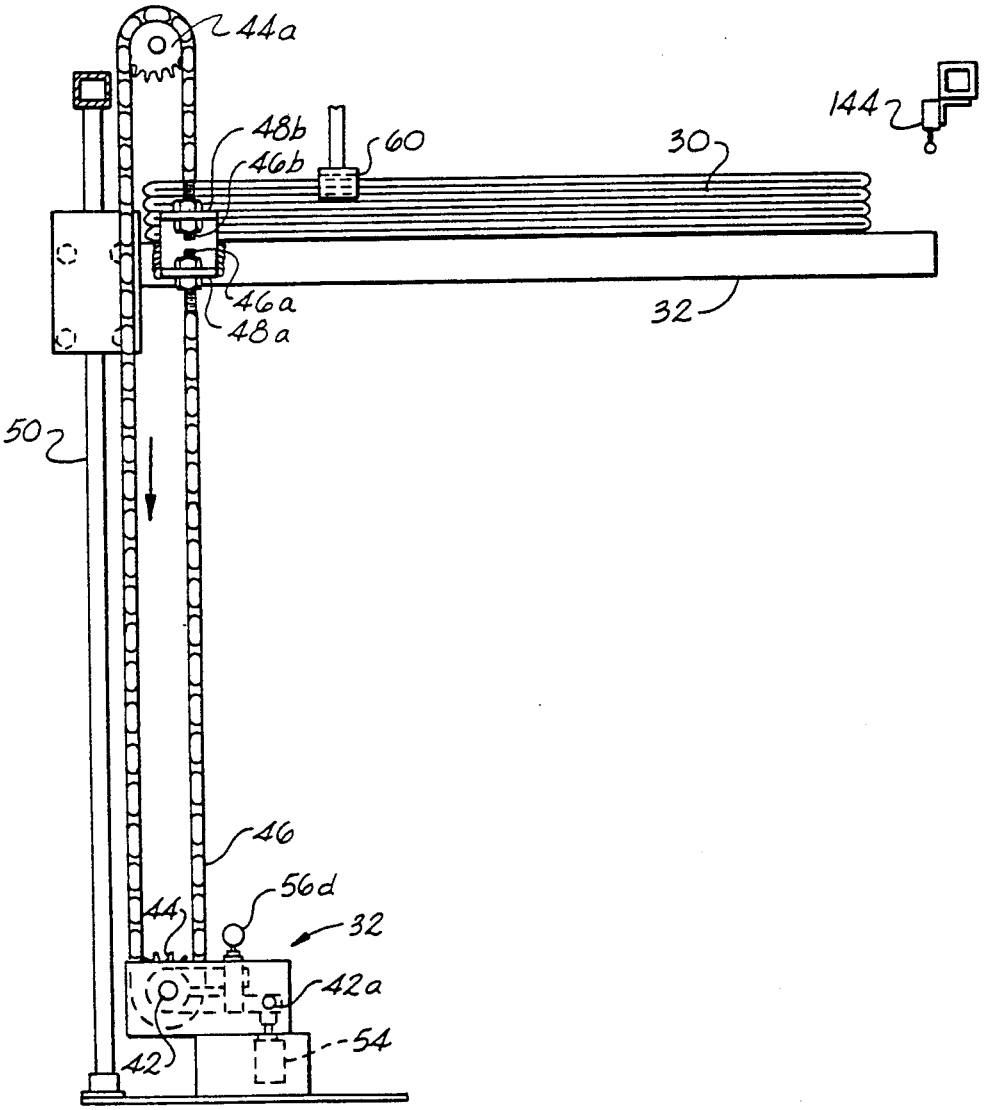
FIG. 12 is a sectional view taken along line 12—12 of FIG. 1.

As can best be seen in FIGS. 10 and 11, indexing means for raising platform 31 is provided by a ratchet mechanism 32 which includes a pair of overriding clutches 36 and 38 mounted in two separate split housings 40, and which rotate on a drive shaft 42. Drive shaft 42 turns a sprocket 44 that drives a chain 46 which raises and lowers platform 31. For this purpose, chain 46 has a first end 46*a* attached to a flange 48*a* attached to a bearing block 48 which slides on a guide post 50. A second end 46*b* of chain 46 is attached on a rear side to a second flange 48*b* attached to bearing block 48. In this manner, bearing block 48 is raised when a front run of chain 46 is lowered. There are a pair of bearing blocks 48 which are affixed to platform 31 a diagonal corners, both of which slide on a vertical slide post 50. Sprocket 44 moves inventory platform 31 up in precise increments under the action of the overriding clutches 36 and 38. Overriding clutch 36 acts as a lock in allowing shaft 42 to rotate only in a clockwise direction. Overriding clutch 38 acts as a driver in rotating shaft 42. Each split clutch housing 40 includes a first clutch housing arm 40*a* and a second clutch housing arm 40*b*. The clutch housing and clutch arms are split at 40*c*. A ratchet housing 52 rotatably supports shaft 42 and the overriding clutches together with split clutch housings 40. A double actuating air cylinder 54 is affixed to a bottom part of ratchet housing 52 at a pivot 52*a*. Air cylinder 54 includes a piston rod 54*a* attached to clutch housing arm 40*a* of drive clutch 38 at a clevis 54*b*. Cylinder 54 rotates clutch housing arm 40*a* as piston rod 54*a* extends to rotate shaft 42 counterclockwise through clutch 38 (as viewed in FIGS. 10–12). Clutch arm 40*a* of locking clutch 36 is affixed to a side of ratchet housing 42 by a bolt 42*a* so that locking clutch 36 prevents shaft 42 from rotating in an opposite direction between drive strokes of piston 54*a* and clutch 38. Each of the split clutch housings 40 has a toggle linkage lock 56 which clamps the split clutch housing arms 40*a* and 40*b* together in a press fit so that they move as one piece. Toggle linkage lock 56 includes linkage 56 which pivots about a pivot 56*a* attached to arm 40*a*, as can best be seen in FIG. 11. There is a lock pin 56*b* carried by housing arm 40*b*. Movement of the linkage 56 to a vertical position, as shown, causes arms 40*a* and 40*b* to be forced towards another by action of tapered V-groove 56*c* formed in linkage 56. This causes the split 40*c* and split housing 40 to close whereupon clutch 38 is driven by movement of arm 40*a*, and clutch 36 free wheels. On the down stroke of piston 54*a*, clutch 38 free wheels and clutch 36 holds shaft 42 against rotation. For purposes of engaging and disengaging the toggle linkage lock, there is a knob 56*d* carried atop each linkage. Thus, clutch 36 provides a latch means which latches the indexing means and platform 31 at box pick-up height H. Means for releasing the latch means provided by clutch 36 is provided by releasable toggle linkages 56 which allow platform 31 to descend for reloading of boxes. During descent, brake means for braking the descent will be provided by cable cylinder 58. This allows normal ratcheting action by the ratchet mechanism and lifting of the inventory platform in precise increments. Releasing the toggle linkage lock allows expansion of a hole diameter 56*a*, thus freeing the clutch within the housing so it can now rotate in an opposite direction against which the clutch had been previously locked so that the inventory platform may be lowered. Clutch 38 drives shaft 42 in rotation to advance sprocket 44 and inventory platform 30 in a precise increment. Overriding clutch 36 is installed on shaft 40 to clutch an opposite rotational direction so that it free-wheels about shaft 42 as shaft 42 is rotated by engaged clutch 38. As piston rod 54*a* is retracted, clutch 38 will free-wheel while clutch 36 will engage so that shaft 42 does not rotate in an opposite direction, but is locked at that platform height. This maintains the height of inventory platform 30 to which it was lifted by the extension of piston rod 54*a*. Clutches 36 and 38 may be any suitable clutches such as a roller bearing clutch manufactured by Torrington Company of Torrington, Conn., as dc overriding clutches. Thus, it can be seen that ratched mechanism 32 allows inventory platform 31 to be raised in increments to maintain the correct inventory height H and when released the clutch override permits lowering the platform. Height sensor 34 is preset to operate at the correct inventory height and shuts off operation of cylinder 54 in preventing over-shoot of the inventory height. A cable cylinder 58 is attached to inventory platform 31 which serves as a break when toggle linkage lock 56 on clutches 36 and 38 is released. A throttle valve adjusts the maximum speed of the downward motion of the inventory. Cable cylinder 58 may be any suitable cable cylinder such as one manufactured by the Tol-O-Matic Corporation of Minneapolis, Minn. A carton keeper 60 is carried by frame 10 and prevents misalignment of boxes 30 as transfer arm A returns to a pick-up position allowing contact of vacuum cups with the cartons.

Figure 3:
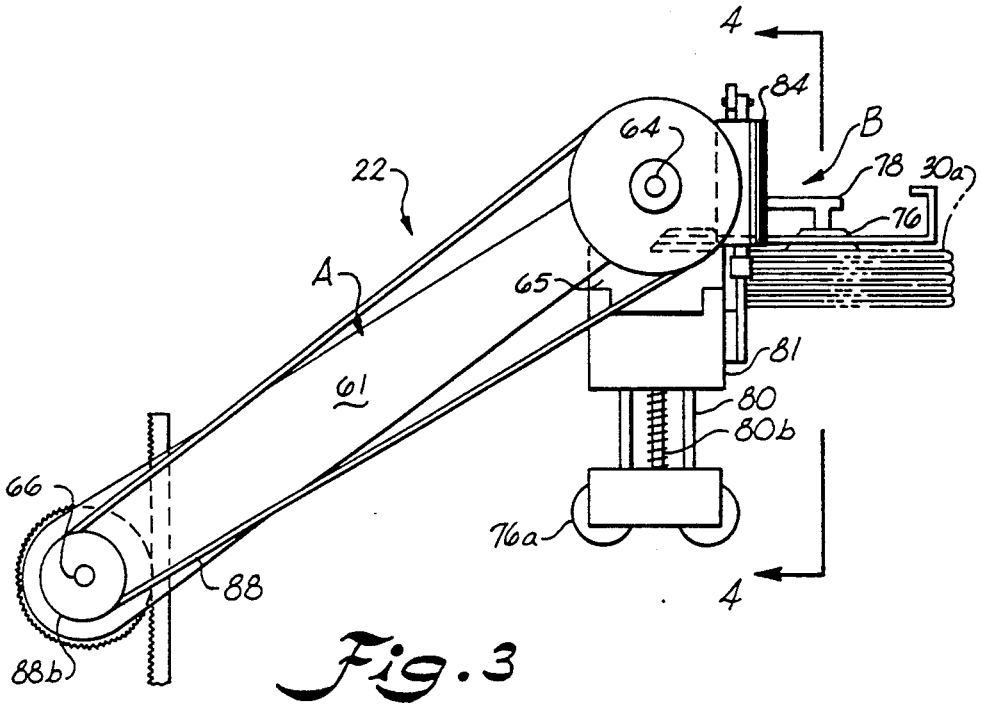
FIG. 3 is a side elevation illustrating a transfer arm assembly and a vacuum assembly according to the invention.
Figure 4:
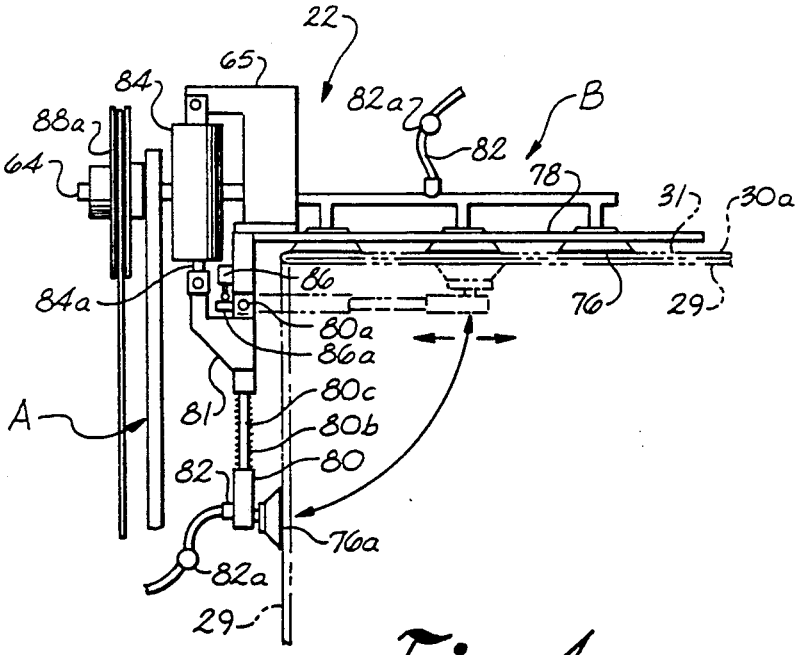
FIG. 4 is a sectional view taken along line 4—4 of FIG. 3.

Referring now to transfer section 22, transfer means for picking up a carton from inventory, opening the carton, and placing and holding the carton in closure section 24 will now be described. As can best be seen in FIGS. 3 and 4, there is a transfer arm assembly A having a base 62 carried by frame 10 and an end pivot 64. There is a base pivot 66 carried by base 62 about which an arm 61 of transfer arm assembly A pivots by a drive means which includes a rack 68 and a pinion gear 70. There is a pair of cylinders 72 and 74 which drive rack 68 in a linear motion which rotates pinion gear 70 that is bolted onto arm 61. End pivot 64 provides the pivotal and mounting point for a vacuum assembly, designated generally as B, which includes a plurality of vacuum cups 76. Vacuum assembly B includes a first vacuum pick-up arm 78 and a second box opening arm 80 carried by a bracket 65 which is affixed to pivot shaft 64. Pick-up arm 78 includes a plurality of vacuum cups 76, and opening arm 80 includes a plurality of vacuum cups 76*a*. Box opening arm 80 pivots about a pivot 88 carried by brackets 65 and includes an axially displaceable pivot rod 80*b* which slides within bracket 81 that is affixed to a piston rod 84*a* of cylinder 84. Box opening arm 80 pivots inwardly to engage an end 29 of box 30. Because of the box thickness when the ends and sides are knocked down, as illustrated in FIG. 4, it is necessary to spring-load displaceable pivot rod 80*b* so that when the box opening arm pivots 90°, as shown in full lines in FIG. 4, the suction cup is not disturbed in its position on the end 29 of box 30. If the pivot arm did not change its length, the suction cup would be pulled inwardly upon the outward pivoting of box opening arm 80 causing the cup to lose its suction. For this purpose, there is a tension spring 80*c* which retracts pivot rod 80*b* and allows it to move outwardly during pivoting. A vacuum is applied to the suction cups through conventional fittings 82 from a vacuum source (not shown). With transfer arm A at a pick-up position, as shown in dotted lines in FIG. 1, vacuum cups 76 of pick-up arm 78 make contact with a top carton 30*a*. Carton height sensor valve 34 is set to insure each carton reaches this. When a vacuum is applied to vacuum cups 76, a vacuum is applied to the carton. A vacuum sensor 82*a* is preset to insure proper grip is maintained during this transfer and a second vacuum sensor 82 provides the same action as the carton end is pulled open by opening arm 80. If either of these sensors sense a vacuum loss during transfer and opening, the machine can be placed on hold for operator assistance. When vacuum sensor 82 senses a vacuum condition, cylinder 72 is extended fully. Cylinders 72 and 74 are double actuating air cylinders. Reaching extension allows cylinder 74 to extend which swings opening arm 80 and vacuum cup 76*a* onto an end 29 of the box. Vacuum sensor 82*a* now senses a preset vacuum on vacuum cup 76*a* which allows cylinder 84 to retract pulling out the carton side and ends forming a square box shape. Cylinder 84 may be any conventional double acting cylinder. At this point, a sensor 86 senses the presence of an operator 86*a* to let the system know cylinder 84 has retracted. The retraction signal from sensor 86 and vacuum sensor signal from 82*a* may be used to signal extension of cylinder 74 which moves rack 68 further upwards pivoting the opened box into closure section 24. Cable 88 is connected to pivot points 64 and 66 of pivot arm A to provide proper timing of rotation of the box from a horizontal to a vertical position for flap closure. The transfer drive means for driving transfer arm A includes a first drive means provided by rack 68 and pinion gear 70 as actuated by cylinders 72 and 74. This rotates arm A approximately 158° the box pick-up position, as shown in FIG. 1, to the box closure position wherein the box is vertically disposed at closure section 22. Intermediate the pick-up position and box closure position is the box-opening position which is approximately 79° counter-clockwise from the pick-up position. Transfer drive means includes a second drive which rotates vacuum assembly B as transfer arm A rotates from the pick-up position to the box closure position. The second drive rotates vacuum assembly generally 90° so that the box is rotated horizontally from the pick-up position to an erect vertical configuration at the closure position at closure section 22. Preferably, the second drive means includes a belt drive provided by belt 88 which encircles a drive pulley 88*a* affixed to pivot shaft 64 and a drive pulley 88*b* affixed to pivot shaft 66. Drive pulleys 88*a* and 88*b* provide a prescribed drive ratio so that vacuum assembly B rotates generally 45° from the pick-up position to the box-opening position, and 45° from the box-opening position to the box closure position, as arm A travels 158°. Cylinder 72 is affixed to vertical frame leg 12. Cylinder 74 is affixed to piston rod 72*a* of cylinder 72. Piston rod 74*a* of cylinder 74 is attached to rack 68. Cylinders 72 and 74 provide the motion to rotate transfer arm A in two steps. First, cylinder 72 rotates the transfer arm approximately 79° from the pick-up position which allows room for end opening cylinder 84 to open the box into a square or rectangular form. At the same time, the top box is rotated 45° during travel to the box-opening position. If vacuum is lost in this function of operation, the machine will not proceed to the next sequence. Second, cylinder 74 extends only when the box-end opening cylinder 84 has retracted.

Figure 5:
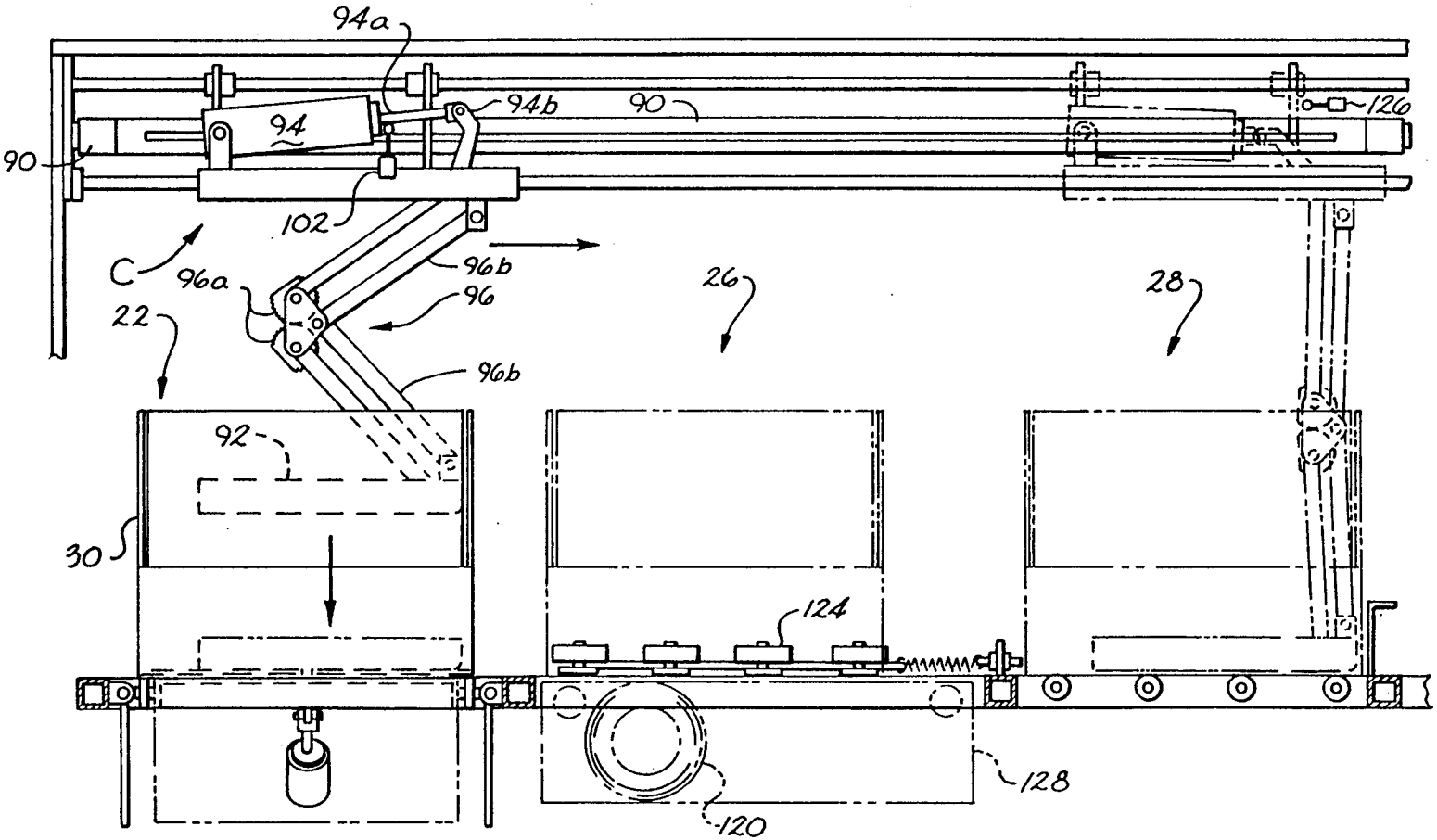
FIG. 5 is a side elevation illustrating a box erector wherein an erected box is being processed through a flap closure section, a taping section, and an exit section by use of a pressure foot according to the invention.
Figure 8:
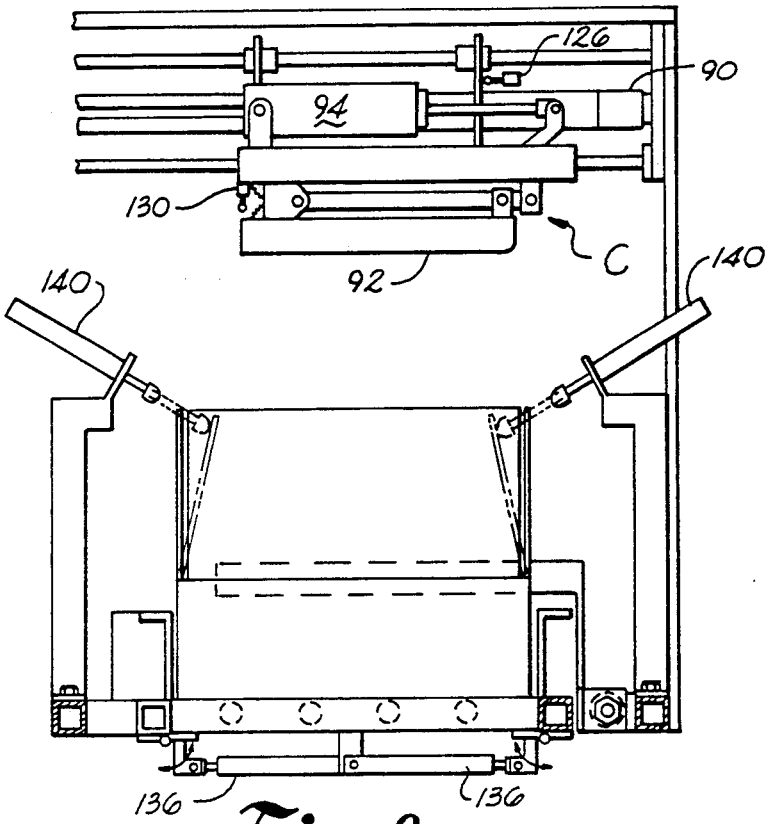
FIG. 8 is a side elevation of an exit section of a box erector according to the invention.

Referring now to closure section 24, the closure section is sequenced to close end flaps 29*a* and then side flaps 31*a* of the ends and sides, respectively, of the box. When transfer arm A positions box 30 into closure section 34, a tape cylinder 90 is actuated to extend a pressure foot assembly, designated generally as C, over the box. Tape cylinder 90 is preferably a conventional band cylinder which is available from the Tol-O-Matic Corporation. Pressure foot assembly C includes a pressure foot 92, a pressure foot cylinder 94, and a retraction and extension mechanism, designated generally as 96. Mechanism 96 includes meshing gears 96*a* and linkage arms 96*b* actuated through the gears. Cylinder 94 may be any suitable conventional double actuating air cylinder. Upon extension of tape cylinder 90 to a left-most position, as can best be seen in FIG. 5, a sensor 98 is engaged and activated which may be used as a signal to activate pressure foot cylinder 94. Actuation of pressure foot cylinder 94 extends pressure foot 92 into the open box, as can best be seen in FIGS. 5–7. The pressure foot stabilizes the box during flap closure. When the pressure foot is extended into a box, end flap cylinders 100 are actuated which closes end flaps 29*a*. Piston rod 94*a* has an end connected to extension/retraction mechanism 96 at a pivot 94*b*. When pressure foot 92 is extended into an open box, pivot end 94*b* is retracted to the left. This position may be sensed by a sensor 102. The signal from sensor 102 may be utilized to actuate cylinders 100 to close end flaps 29*a*. For this purpose, cylinders 100 include piston rods 100*a* attached to a clevis 100*b* that is attached to a pivot rod 102 to which is affixed a closure rod 102*a* which provide an end flap closure means. Extension of cylinders 100 causes rod 102*a* to pivot counter-clockwise and engage end flaps 29*a* raising them to a horizontal position, as can best be seen in FIG. 6. Cylinders 100 may be any conventional double actuating air cylinder. A sensor 104 and operator 104*a* may be utilized to sense extension of cylinders 100, as can best be seen in FIG. 2.

The signal from sensor 104 may be utilized to actuate a side flap closure means which includes a pair of cylinders 106 which pivot arms 108 that carry side plates 110 which extend across the width of side flaps 31*a*, as can best be seen in FIG. 7. It is to be appreciated that closure bars 102*a* are provided in the form of a simple narrow bar while closure plates 110 are provided having a width about the same as the width of side flaps 31*a*. This provides the expedient that end flap bars 102*a* may be accommodated between the opposing edges of side flaps 31*a* to hold end flaps 29*a* horizontal while side flaps 31*a* are being closed by cylinders 106, as can best be seen in FIG. 7. A stationary sensor 112 and a movable operator 112*a* carried by a pivot shaft 108*a* provide a signal to indicate the side flaps have been closed (FIG. 2). The side flap closure signal may be used to actuate tape cylinder 98 to retract the cylinder moving pressure foot assembly C and box 30 to the right, as can best be seen in FIG. 5. As box 30 moves to the right, it moves across tape section 26.

As can best be seen in FIG. 2, tape section 26 includes tape applicator 120, side squeeze rolls 122, and idler rolls 124. Pressure foot 92 extended into the open box, within its side flaps closed, the pressure foot moves the box, with pressure applied to the bottom flaps, over tape applicator 120. Before the box strikes the tape applied by tape applicator 120, squeeze rollers 122 force the bottom flaps together which eliminates the gap between the two side flaps to insure a tight seal of the bottom. Side squeeze rollers 122 also act as a centering guide for the box as tape is applied to the box. As tape cylinder 90 reaches its home position, which is retracted to the right, a sensor 126 is actuated which causes pressure foot cylinder 94 to retract pressure foot 92 from the box. Tape section 26 may include a conventional taper unit manufactured by Customized Equipment Southeast, Inc. of Tucker, Ga.

Figure 9:
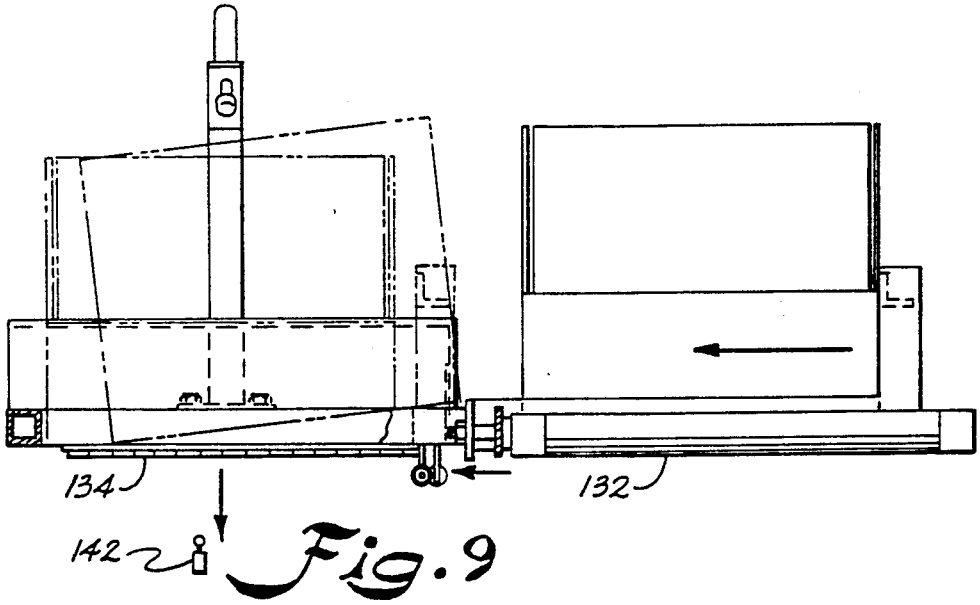
FIG. 9 is an end view of an exit section of a box erector according to the invention.

Referring now to exit section 28, a sensor 130 may be utilized to sense the retracted position of pressure foot 92, as can best be seen in FIG. 9. In the exit section, the box is positioned so that it can be indexed into a feed system to receive a product. Exit section 24 includes an exit cylinder 132 which pushes box 30 into drop hinges 134 which provide a box release means. For this purpose, exit cylinder 132 includes a generally L-shaped arm 132*a* carried by the cylinder which pushes box 30 to the side over drop hinges 134 when exit cylinder 132 is extended. Drop hinges 134 allow the box to drop only when space is available on the feed system below. Space availability may be sensed by a sensor valve (not shown) on the customers feed system which can be utilized to actuate a pair of drop cylinders 136 which actuate the drop hinges 134. A pair of top flap cylinders 140 may be provided to break the crease of the top flaps so that they may be more easily closed at a subsequent step. After box 30 is dropped by drop hinges 134, a new box erection cycle will begin automatically and continue until the inventory of unfolded boxes is depleted which shuts the machine down. A sensor 142 may sense box 30 as it is dropped to a position. A sensor 144 may be utilized to sense the position of inventory platform 30 when it is empty. In this manner, signal from sensor 142 may be utilized to start a new box erection cycle and a signal from sensor 144 may be utilized to shut the machine down.

Preferably, the air cylinders in operation described above are done pneumatically. The sensors which have been described may be any suitable air valves such as three-way or four-way air control valves manufactured by Humphrey Products Company of Kalamazoo, Mich. Suitable air cylinders are manufactured by the Compact Air Products Corporation of Westminster, S.C., and suitable vacuum cups, sensors, and generators, are available from Vaccon Corporation of Norwood, Mass. The arrangement of a suitable pneumatic control circuit including switches, valves, and pneumatic hoses, is within the purview of one skilled on the pneumatic control art and having been taught the operation and advantages of the present invention.

While a preferred embodiment of the invention has been described using specific terms, such description is for illustrative purposes only, and it is to be understood that changes and variations may be made without departing from the spirit or scope of the following claims.

What is claimed is:

1. Apparatus for erecting a rectangular box from a folded knock-down box, said rectangular box having a pair of spaced apart sides, a pair of spaced apart ends, a pair of bottom end flaps and a pair of bottom side flaps, and a pair of top end flaps and a pair of top side flaps, said apparatus comprising:

an inventory section which includes inventory means for maintaining a stack of said knock-down boxes with a top box in a pick-up position;

a transfer section which includes transfer means for engaging a first side of a top box which is disposed on top of said stack of knock-down boxes and picking up and transferring said top box to a box-opening position, and said transfer means includes box opening position, and said transfer means includes box opening means for engaging a second side of said top box and opening said box into an open rectangular box at said box-opening position;

a closure section which receives said rectangular box at a box closure position, and said closure section includes closure means for folding a pair of said end and side flaps of said box inward for closure;

said transfer means transferring said open rectangular box from said box-opening position to said closure section after said box has been opened and said transfer means rotating said first side of said box generally ninety degrees during transfer from said inventory section to said closure section; and a taping section which includes taping means form securing said end and side flaps in a closed configuration to form a box enclosure.

2. The apparatus of claim 1 including indexing means for raising said stack of knock-down boxes a prescribed distance each time said transfer means picks up one of said top boxes so that a box previously underneath said top box is raised to a predetermined pick-up height and becomes a new top box.

3. The apparatus of claim 2 wherein said inventory means includes a platform on which said stack of knock-down boxes are carried, and said indexing means includes indexing drive means connected to said platform for raising said platform each time said top box is picked up from said stack.

4. The apparatus of claim 3 wherein said index means includes latch means which latches said indexing means and platform at said pick-up height.

5. The apparatus of claim 4 including release means for releasing said latch means so that said platform may be returned to a bottom reload position for reloading of a stack of said knock-down boxes.

6. The apparatus of claim 5 including brake means for braking a descent of said platform when lowered to said reload position.

7. The apparatus of claim 1 including indexing means for raising said stack of knock-down boxes a prescribed distance each time said transfer means picks up one of said top boxes so that a box previously underneath said top box is raised to a predetermined pick-up height and becomes a new top box; and release means for releasing said indexing means so that :said platform may be returned to a bottom position for reloading of a stack of said knock-down boxes.

8. The apparatus of claim 7 including brake means for braking a descent of said platform when lowered to said reload position.

9. The apparatus of claim 1 including alignment means for maintaining said stack of knock-down boxes generally in a vertical stack.

10. The apparatus of claim 9 wherein said alignment means includes keeper means for preventing underneath boxes from shifting when said top box is engaged by said transfer means.

11. The apparatus of claim 1 wherein said transfer means includes a transfer arm, and transfer drive means for rotating said transfer arm through a prescribed angle between said box pick-up, box opening, and box closure positions.

12. The apparatus of claim 11 wherein said transfer drive means includes first drive means for rotating said transfer arm means through a first prescribed angle between said box closure and pick-up positions, and for rotating said transfer arm through a second prescribed angle less than said first prescribed angle and in an opposite direction.

13. The apparatus of claim 12 wherein said transfer means includes a base pivot having a pinion gear affixed to said transfer arm and carried by said base pivot; and said first drive means includes a rack gear meshing with said pinion, and a first fluid cylinder having a piston rod affixed to said rack gear, and a second fluid cylinder carried by a frame having a piston rod on which said first fluid cylinder is carried so that both of said fluid cylinders are actuated to move said transfer arm between said closure and pick-up positions.

14. The apparatus of claim 13 wherein one of said first and second fluid cylinders rotates said transfer arm from said pick-up position to said box-opening position and the other of said fluid cylinders rotates said transfer arm from said box-opening position to said closure position.

15. The apparatus of claim 12 wherein said first prescribed angle is about 158°, and said second prescribed angle is about 79° from said pick-up position.

16. The apparatus of claim 12 including a vacuum assembly carried by said transfer arm for picking up at least one of said sides and ends of said top box.

17. The apparatus of claim 16 wherein said vacuum assembly includes a first arm having suction means for engaging a side of said knock-down box in said pick-up position, and a second pivotal arm having suction means for engaging an end of said knock-down box in said box-opening position.

18. The apparatus of claim 17 wherein said second pivotal arm includes a pivot having a displaceable pivot rod carried by said pivot which has a first pivot position corresponding to engaging an end of said knock-down box, and a second pivot position corresponding to engagement with said end when said end is perpendicular to said side of said open rectangular box, said second pivot position being axially displaced from said first pivot position.

19. The apparatus of claim 18 wherein said displaceable pivot rod is spring-loaded in the axial direction.

20. The apparatus of claim 18 wherein said suction means includes a plurality of suction cups for connection to a vacuum source.

21. The apparatus of claim 18 including suction sensing means for sensing application of a suction on said sides of said box when picked up by said first and second arms of said vacuum assembly;

22. The apparatus of claim 18 wherein said first and second arms of said vacuum assembly include widened box support plates which carry said suction means against which said side and end of said box are drawn into engagement under suction for supporting said box.

23. The apparatus of claim 16 wherein said transfer drive means includes a second drive means for rotating said vacuum assembly generally 90° to rotate said box horizontally from said pick-up position to an erect vertical orientation at said closure position as said transfer arm rotates between said pick-up and closure positions.

24. The apparatus of claim 23 wherein said second drive means includes a belt drive connected between said base pivot and an end pivot carried near an end of said transfer arm which pivotally carries said vacuum assembly, and said belt drive includes drive pulleys carried by said base pivot and end pivot carry about which an endless belt is carried to provide a desired drive ratio to rotate said vacuum assembly generally 90° as said transfer arm is rotated substantially more than 90° between said box pick-up and closure positions.

25. The apparatus of claim 1 including a pressure foot assembly which includes a pressure foot and first actuating means for moving said pressure foot vertically between a retracted position and a lowered position, said pressure foot engaging an inside bottom of said box in said closure position in said closure section when in said extended position to exert pressure on said end and side flaps of said box when being closed.

26. The apparatus of claim 25 including second actuating means for moving said pressure foot horizontally from said closure section, through said taping section, and to an exit section.

27. The apparatus of claim 25 wherein said closure section includes end flap closure means for closing said end flaps of said box in said closure position, and side flap closure means for closing said side flaps of said box.

28. The apparatus of claim 27 wherein said end flap closure means includes a movable bar which engages said end flaps and fits within a gap defined by adjacent edges of said side flaps for holding said end flaps closed while said side flaps are being closed upon said end flaps, and first closure actuating means for moving said bar to engage and close said end flaps.

29. The apparatus of claim 28 wherein said side flap closure means includes an elongated closure member engaging said side flaps over a substantial length of said side flaps, and second closure actuating means for moving said elongated closure member to engage and close said side flaps upon said end flaps.

30. The apparatus of claim 1 wherein said taping section includes squeeze means for engaging sides of said box prior to entering said taping section for reducing a gap between said closed side flaps prior to the application of tape over said gap and side flaps.

31. The apparatus of claim 30 wherein said squeeze means includes a squeeze roller assembly having a plurality of laterally movable squeeze rollers biased toward said sides of said box entering said taping section for urging said side flaps towards each other to reduce said gap.

32. The apparatus of claim 31 wherein said squeeze roller assembly includes a plurality of idler rollers on a side of said box opposite said movable rollers.

33. The apparatus of claim 1 including an exit section having means for dispensing said box for being filled with product; and delivery means for moving said box from said closure section to said tape and exit sections.

34. The apparatus of claim 33 including conveyor means along which said box is moved from said taping section to said exit section.

35. The apparatus of claim 34 wherein said exit section includes box engagement means for moving said box laterally off of said conveyor means.

36. The apparatus of claim 35 including release means for releasing said box from said exit section after removal from said conveyor means so that said box may be deposited in a desired location for feeding to a product loading line.

37. Apparatus for erecting a rectangular box from a folded knock-down box, said rectangular box having a pair of spaced apart sides, a pair of spaced apart ends, a pair of bottom end flaps and a pair of bottom side flaps, and a pair of top end flaps and a pair of top side flaps, said apparatus comprising:

an inventory of stacked knock-down boxes having a top box in a pick-up position;

a transfer means for picking up said top box and transferring said top box to a box-opening position;

box opening means for opening said box into an open rectangular box at said box-opening position;

a closure assembly which receives said rectangular box at a box closure position which includes closure means for folding a pair of said end and side flaps of said box inward for closure;

said transfer means transferring said open rectangular box from said box-opening position to said closure section after said box has been opened;

said transfer means includes a transfer arm, and transfer drive means for rotating said transfer arm through a prescribed angle between said box pick-up, box opening, and box closure positions;

said transfer drive means includes first drive means for rotating said transfer arm means through a first prescribed angle between said box closure and pick-up positions, and for rotating said transfer arm through a second prescribed angle less than said first prescribed angle and in an opposite direction; and a vacuum assembly carried by said transfer arm for picking up at least one of said sides and ends of said top box;

said transfer drive means includes a second drive means for rotating said vacuum assembly generally 90° to rotate said box horizontally from said pick-up position to an erect vertical orientation at said closure position as said transfer arm rotates between said pick-up and closure positions.

38. The apparatus of claim 37 including indexing means for raising said stack of knock-down boxes a prescribed distance each time said transfer means picks up one of said top boxes so that a box previously underneath said top box is raised to a predetermined pick-up height and becomes a new top box; and release means for releasing said indexing means so that said platform may be returned to a bottom position for reloading of a stack of said knock-down boxes.

39. The apparatus of claim 37 wherein said transfer means includes a base pivot having a pinion gear affixed to said transfer arm and carried by said base pivot; and said first drive means includes a rack gear meshing with said pinion, and a first fluid cylinder having a piston rod affixed to said rack gear, and a second fluid cylinder carried by a frame having a piston rod on which said first fluid cylinder is carried so that both of said fluid cylinders are actuated to move said transfer arm between said closure and pick-up positions.

40. The apparatus of claim 39 wherein one of said first and second fluid cylinders rotates said transfer arm from said pick-up position to said box-opening position and the other of said fluid cylinder rotates said transfer arm from said box-opening position to said closure position.

* * * * *